US012226035B2

(12) United States Patent
Reithinger

(10) Patent No.: US 12,226,035 B2
(45) Date of Patent: Feb. 18, 2025

(54) HANGER STORAGE CONTAINER AND METHOD OF USING SAME

(71) Applicant: Neil Reithinger, Scottsdale, AZ (US)

(72) Inventor: Neil Reithinger, Scottsdale, AZ (US)

( * ) Notice: Subject to any disclaimer, the term of this patent is extended or adjusted under 35 U.S.C. 154(b) by 0 days.

(21) Appl. No.: 18/523,232

(22) Filed: Nov. 29, 2023

(65) Prior Publication Data

US 2024/0099488 A1 Mar. 28, 2024

Related U.S. Application Data

(62) Division of application No. 17/460,751, filed on Aug. 30, 2021, now Pat. No. 11,882,952.

(60) Provisional application No. 63/072,374, filed on Aug. 31, 2020.

(51) Int. Cl.
*A47G 25/14* (2006.01)
*B65D 25/10* (2006.01)

(52) U.S. Cl.
CPC ..... *A47G 25/1464* (2013.01); *B65D 25/106* (2013.01)

(58) Field of Classification Search
CPC ..... B65D 5/4295; B65D 25/106; A47G 25/1464; A47G 25/1457; A47G 25/1442; A47G 25/005; A47G 25/14; A47G 25/1471
See application file for complete search history.

(56) References Cited

U.S. PATENT DOCUMENTS 2,454,858 A * 11/1948 Burt ..... A47B 61/00 211/49.1
5,730,311 A * 3/1998 Curtis ..... B65D 51/1611 206/508
2006/0113202 A1* 6/2006 Bentley ..... A47G 25/1464 206/300
2019/0135478 A1 5/2019 Appendini et al.

* cited by examiner

*Primary Examiner* — Anthony D Stashick
*Assistant Examiner* — L Kmet
(74) *Attorney, Agent, or Firm* — Ward and Smith, P.A.; Ryan K. Simmons

(57) ABSTRACT

A hanger storage device. The hanger storage device may include a container base, the container base may include a floor and sidewalls. The hanger storage device may further include a divider disposed and extending substantially across the container base from a first corner of the container base to a second corner of the container base diagonally opposite that of the first corner of the container base; two compartments defined at least partially by the floor, sidewalls, and divider; alignment pegs, one disposed in each of the two compartments, wherein the alignment pegs may be formed in the floor and extend perpendicularly upward therefrom, and wherein the alignment pegs may be configured to receive a hook portion of a hanger; and a lid, wherein the lid may be configured to secure atop the sidewalls thereby enclosing the one or more compartments.

8 Claims, 12 Drawing Sheets

HANGER STORAGE CONTAINER AND METHOD OF USING SAME

RELATED APPLICATIONS

This application is a divisional of and claims priority to U.S. patent application Ser. No. 17/460,751, filed on Aug. 30, 2021, the application of which claims priority to U.S. Provisional Patent Application No. 63/072,374, filed on Aug. 31, 2020, the applications of which are incorporate herein by reference in their entireties.

TECHNICAL FIELD

The subject matter of the invention relates generally to storage containers and more particularly to a hanger storage container and method of using same.

BACKGROUND

It can be difficult to organize and store loose clothes hangers that are not being used. For example, it's not easy to organize loose clothes hangers into a standard cardboard box or plastic bin, plus the hangers tend to get tangled all together.

SUMMARY

In one embodiment, a hanger storage device is provided. The hanger storage device may include a container base, the container base may include a floor and one or more sidewalls. The hanger storage device may further include one or more compartments defined at least partially by the floor and the one or more sidewalls; one or more alignment pegs disposed in the one or more compartments, wherein the one or more alignment pegs may be formed in the floor and extend perpendicularly upward therefrom, and wherein the one or more alignment pegs may be configured to receiving a hook portion of the hanger; and a lid, wherein the lid may be configured to secure atop the one or more sidewalls thereby enclosing the one or more compartments. The container base may be a generally box-like structure. The one or more compartments each may be configured to receive a plurality of hangers in a stacked configuration therein. The one or more alignment pegs may be configured to be engageable with the hook portion of the plurality of hangers when received in the one or more compartments. The one or more compartments may include two compartments. The hanger storage device may further include a divider spanning substantially across the container base, and with the floor and the one or more sidewalls forming the two compartments. The divider may span diagonally substantially across the container base. Each of the two compartments may include at least one of the one or more alignment pegs. The two compartments may each be configured to receive a plurality of hangers in a stacked configuration therein. The hanger storage device may further include an arrangement of one or more openings in one or both of the container base and lid. The floor of the container base and the lid each may include an arrangement of the one or more openings formed therein, and wherein the arrangement of the one or more openings formed in the floor of the container base substantially align with the arrangement of the one or more openings formed in the lid. A perimeter edge of the lid and an upper edge of the container base sidewalls may be configured to snap-fit together. The one or more alignment pegs may be disposed in a corner portion of each of the two compartments opposite that of the divider. The one or more compartments may include four compartments. The hanger storage device may further include one or more dividers, wherein the one or more dividers along with the floor and the one or more sidewalls forms the four compartments. The one or more dividers may be disposed and extend generally from each corner of the container base toward a central region of the container base. Each of the four compartments may include at least one of the one or more alignment pegs. The one or more alignment pegs may be arranged generally in a central region of the container base. The four compartments may be each configured to receive a plurality of hangers in a stacked configuration therein.

In another embodiment, a hanger storage device is provided. The hanger storage device may include a container base, the container base may include a floor and sidewalls. The hanger storage device may further include a divider disposed and extending substantially across the container base from a first corner of the container base to a second corner of the container base diagonally opposite that of the first corner of the container base; two compartments defined at least partially by the floor, sidewalls, and divider; alignment pegs, one disposed in each of the two compartments, wherein the alignment pegs may be formed in the floor and extend perpendicularly upward therefrom, and wherein the alignment pegs may be configured to receive a hook portion of a hanger; and a lid, wherein the lid may be configured to secure atop the sidewalls thereby enclosing the one or more compartments. The container base may include a generally box-like structure. The two compartments may each be configured to receive a plurality of hangers in a stacked configuration therein. The alignment pegs may be configured to be engageable with the hook portion of the plurality of hangers when received in the two compartments. Each alignment peg may be disposed in a corner portion of each of the two compartments diagonally opposite that of each other. The hanger storage device may further include an arrangement of one or more openings in one or both of the container base and lid. The floor of the container base and the lid each may include an arrangement of the one or more openings formed therein, and wherein the arrangement of the one or more openings formed in the floor of the container base may substantially align with the arrangement of the one or more openings formed in the lid. A perimeter edge of the lid and an upper edge of the container base sidewalls may be configured to snap-fit together.

In yet another embodiment, a method of storing a plurality of hangers in a hanger storage device is provided. The method may include one or more of providing a hanger storage device; stacking a plurality of hangers in the one or more compartments, wherein the hook portion of the plurality of hangers may engage with the one or more alignment pegs; and securing the lid atop the one or more sidewalls.

BRIEF DESCRIPTION OF THE DRAWINGS

Figure 1:
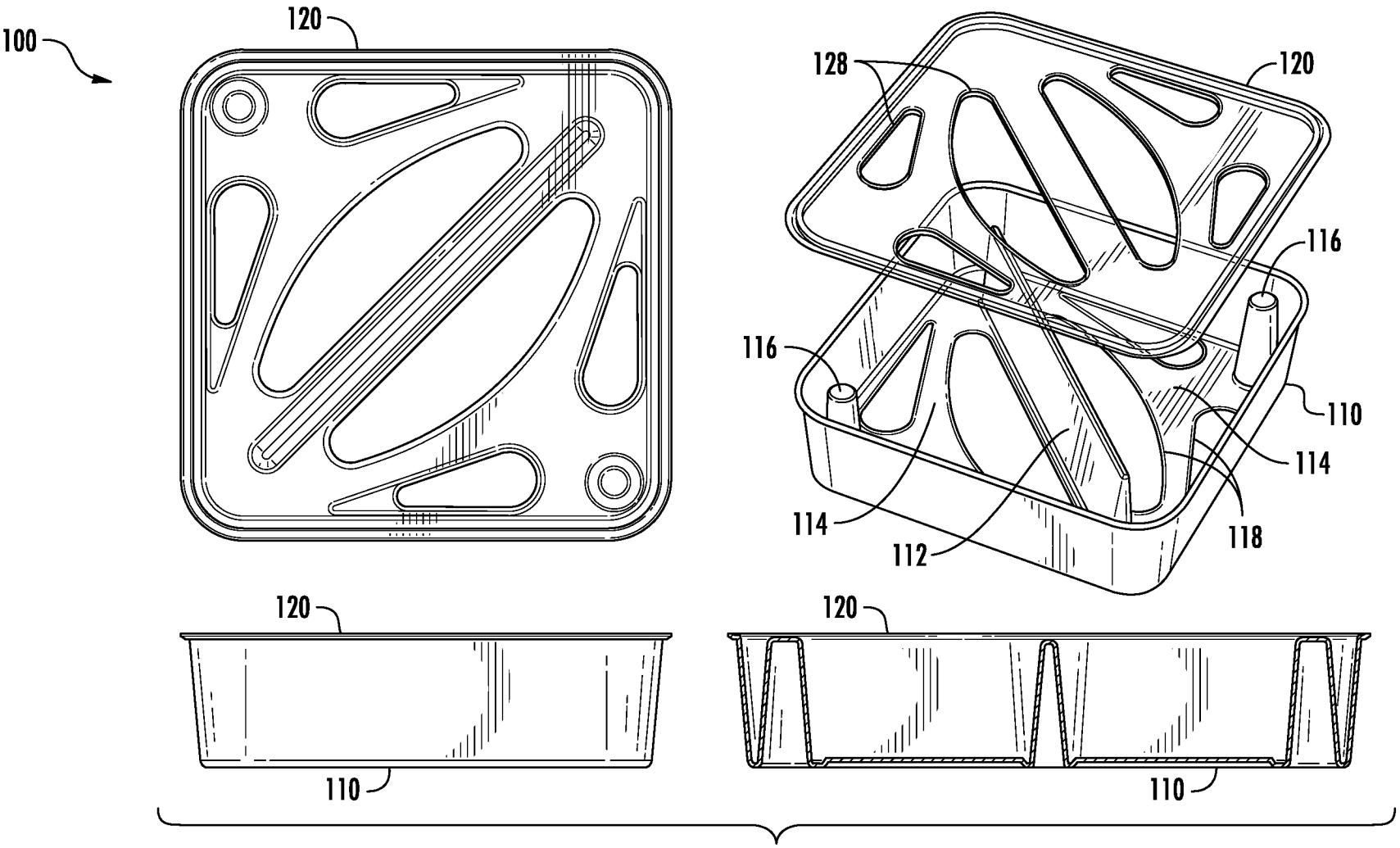
Figure 2:
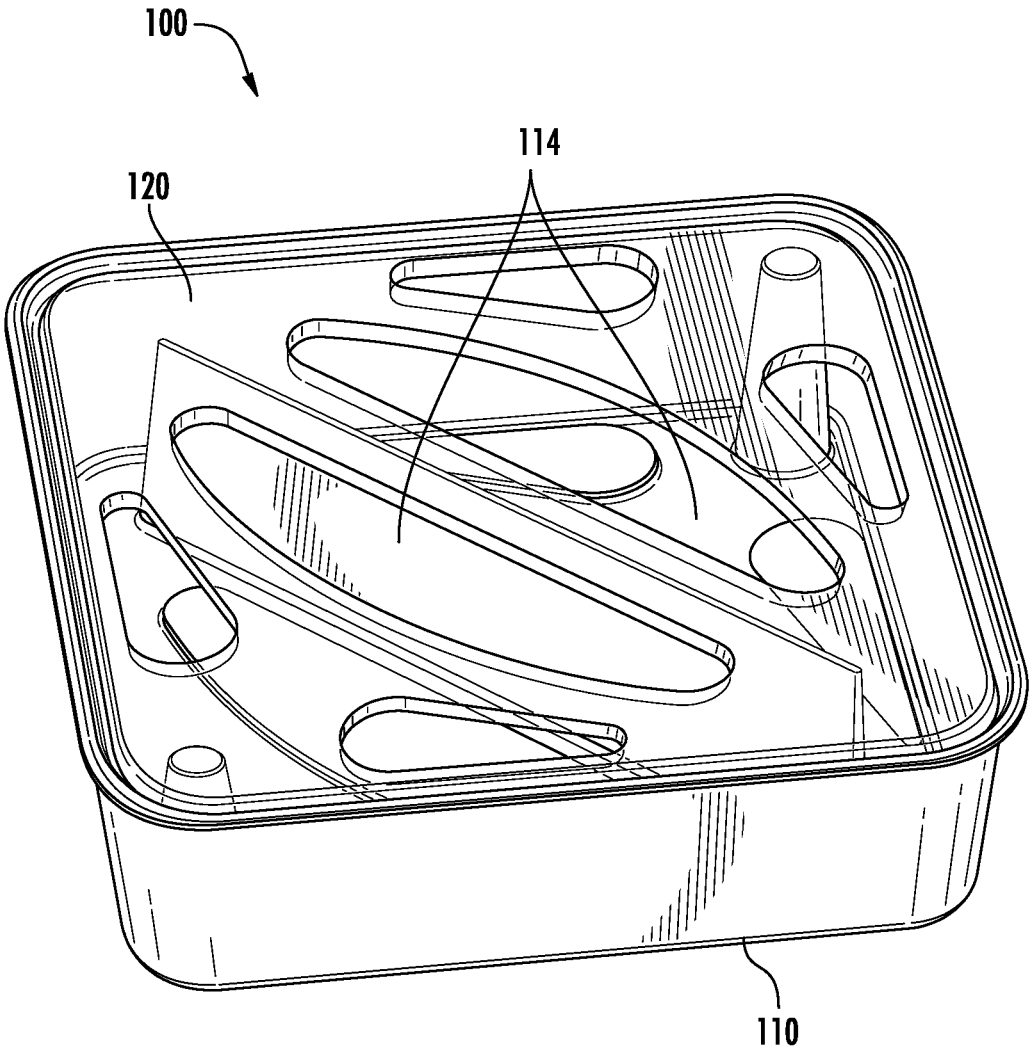
Figure 3:
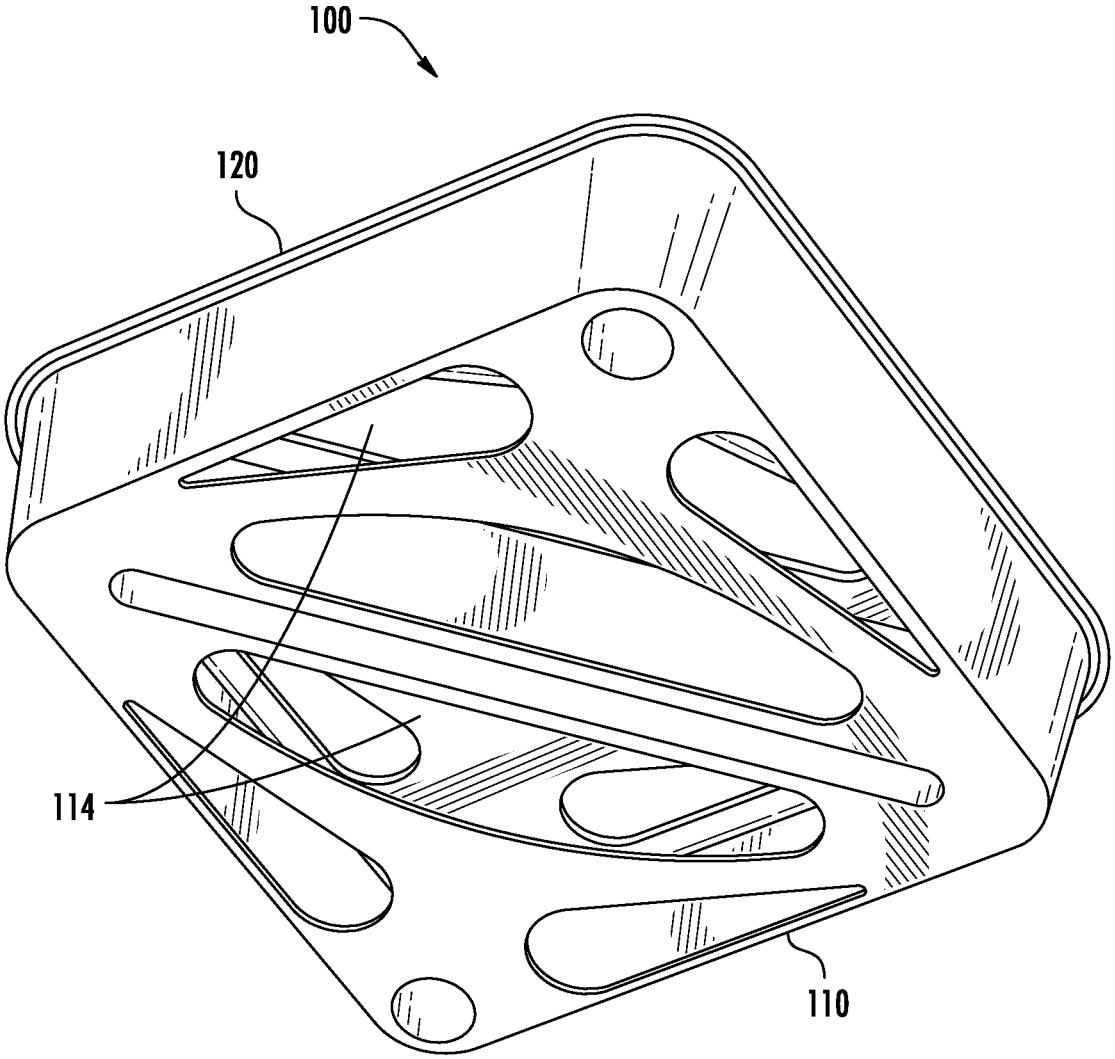
Figure 4:
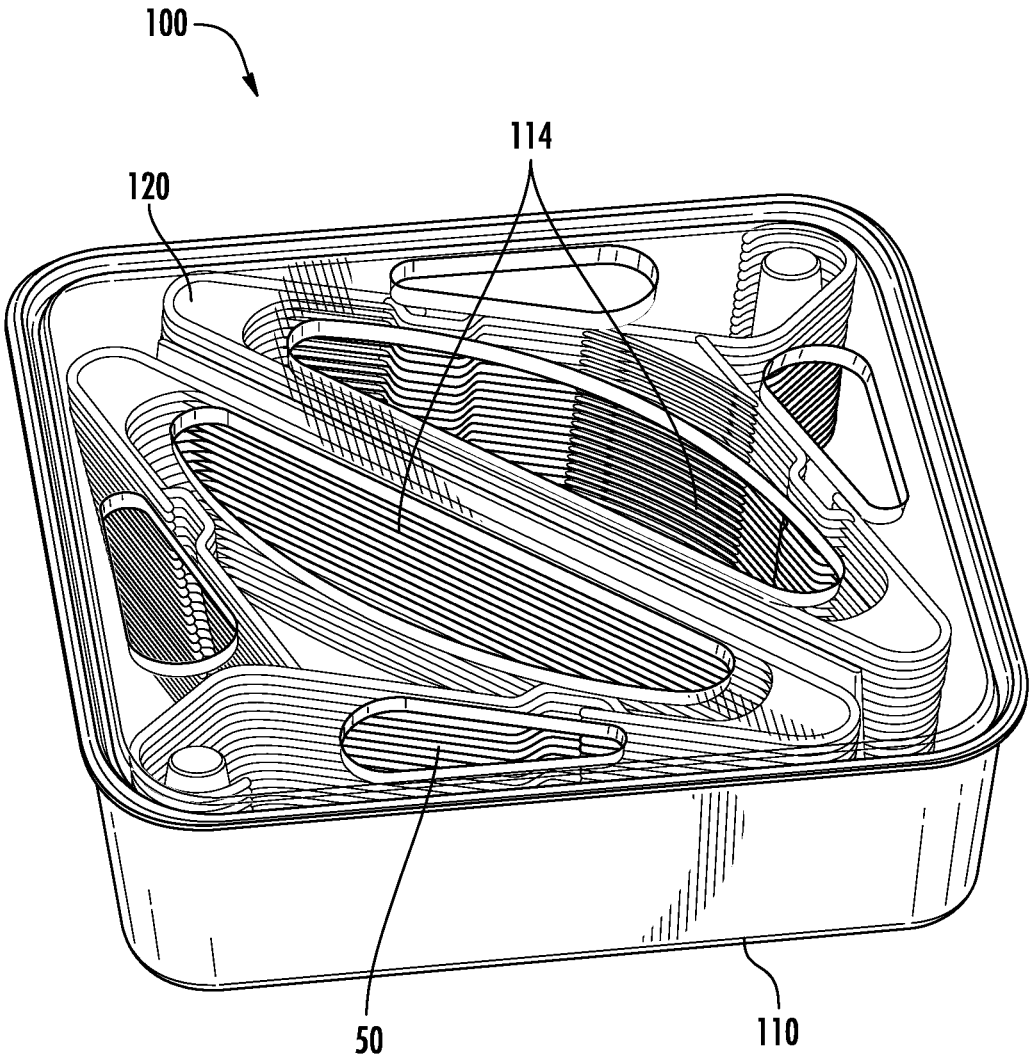
Figure 5:
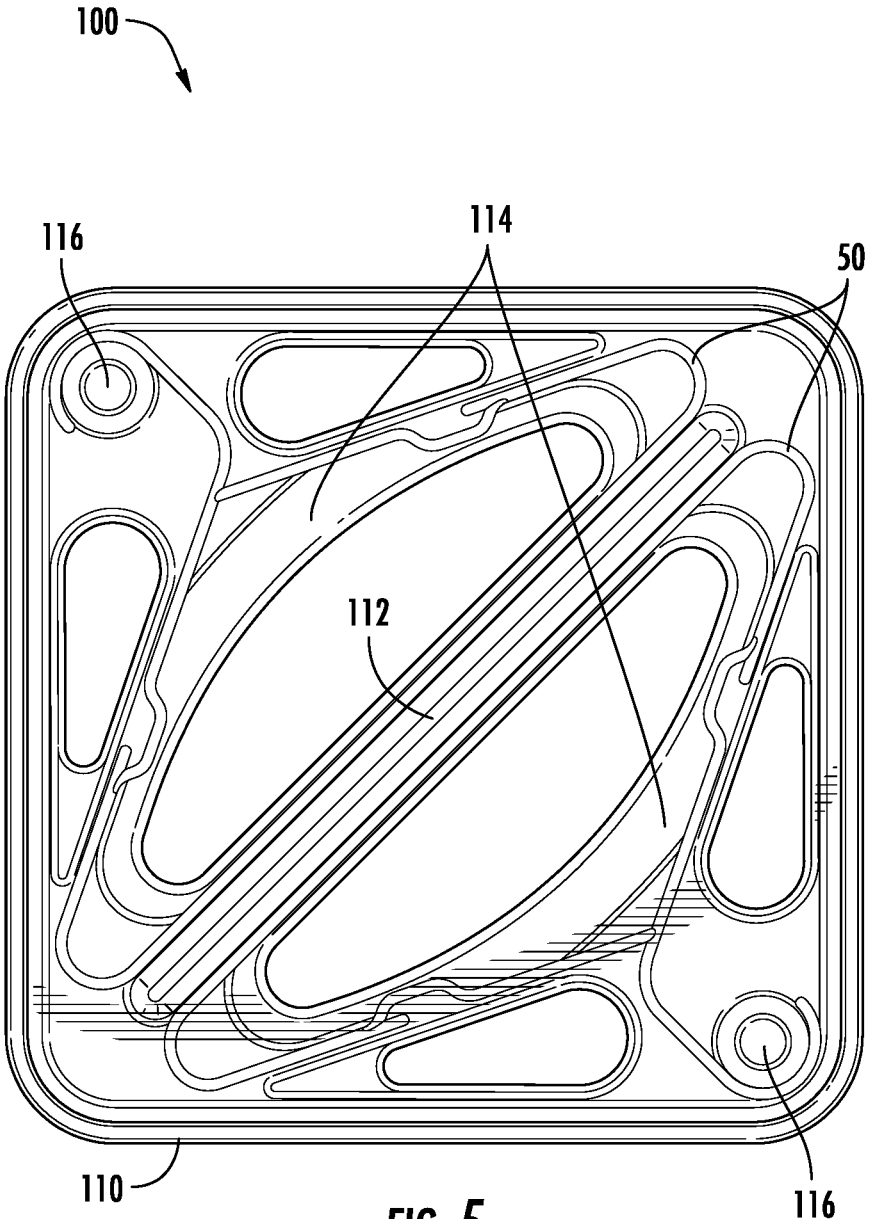
Figure 6:
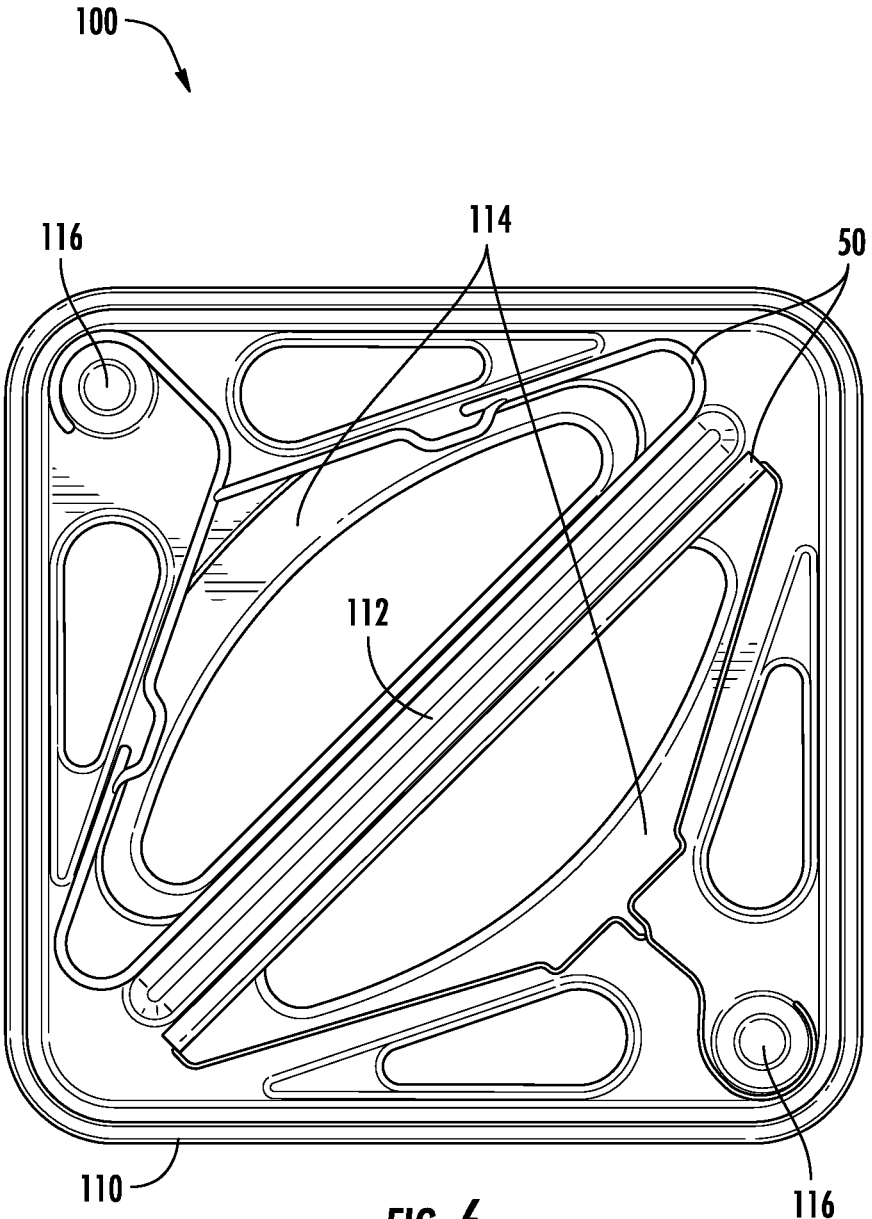
Figure 7:
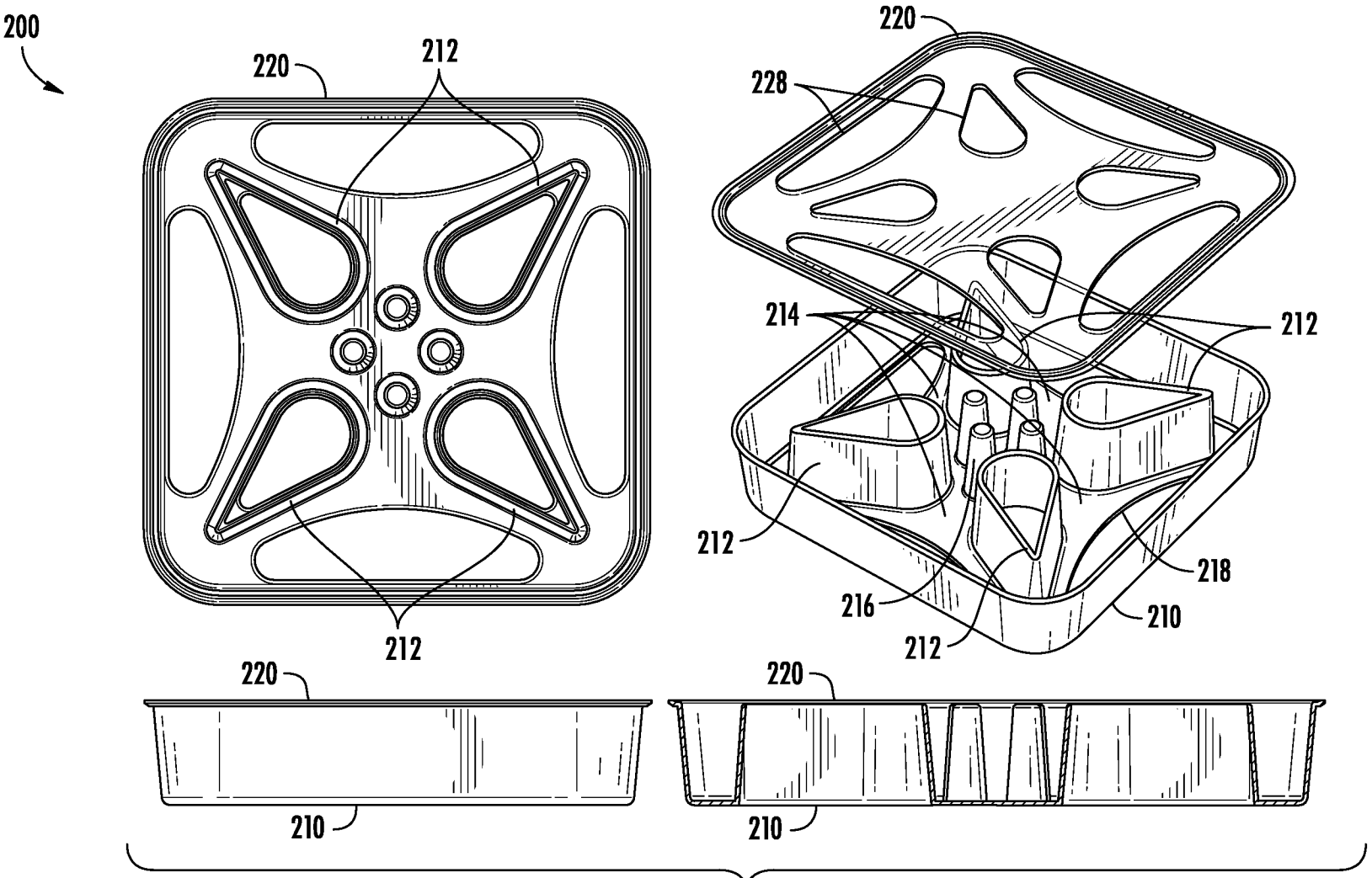
Figure 8:
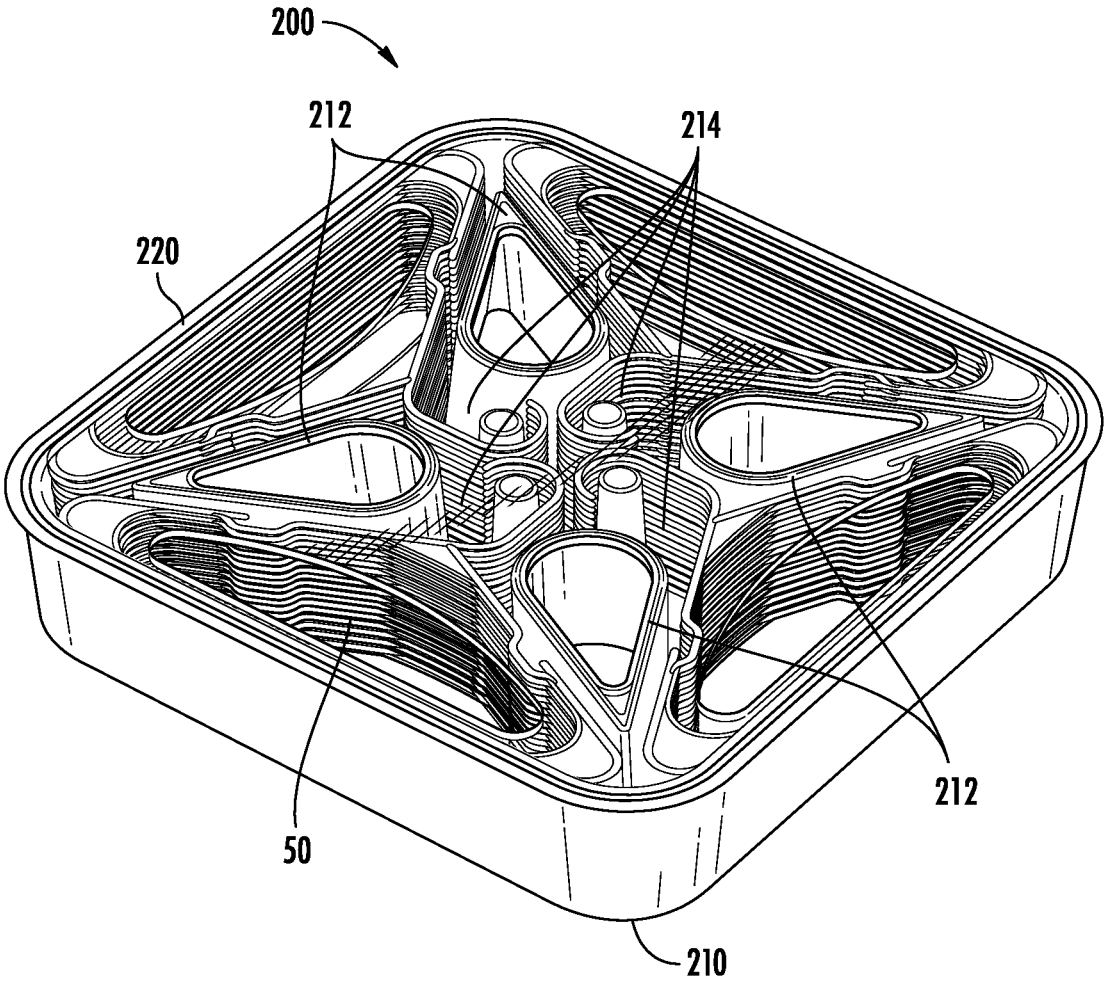
Figure 9:
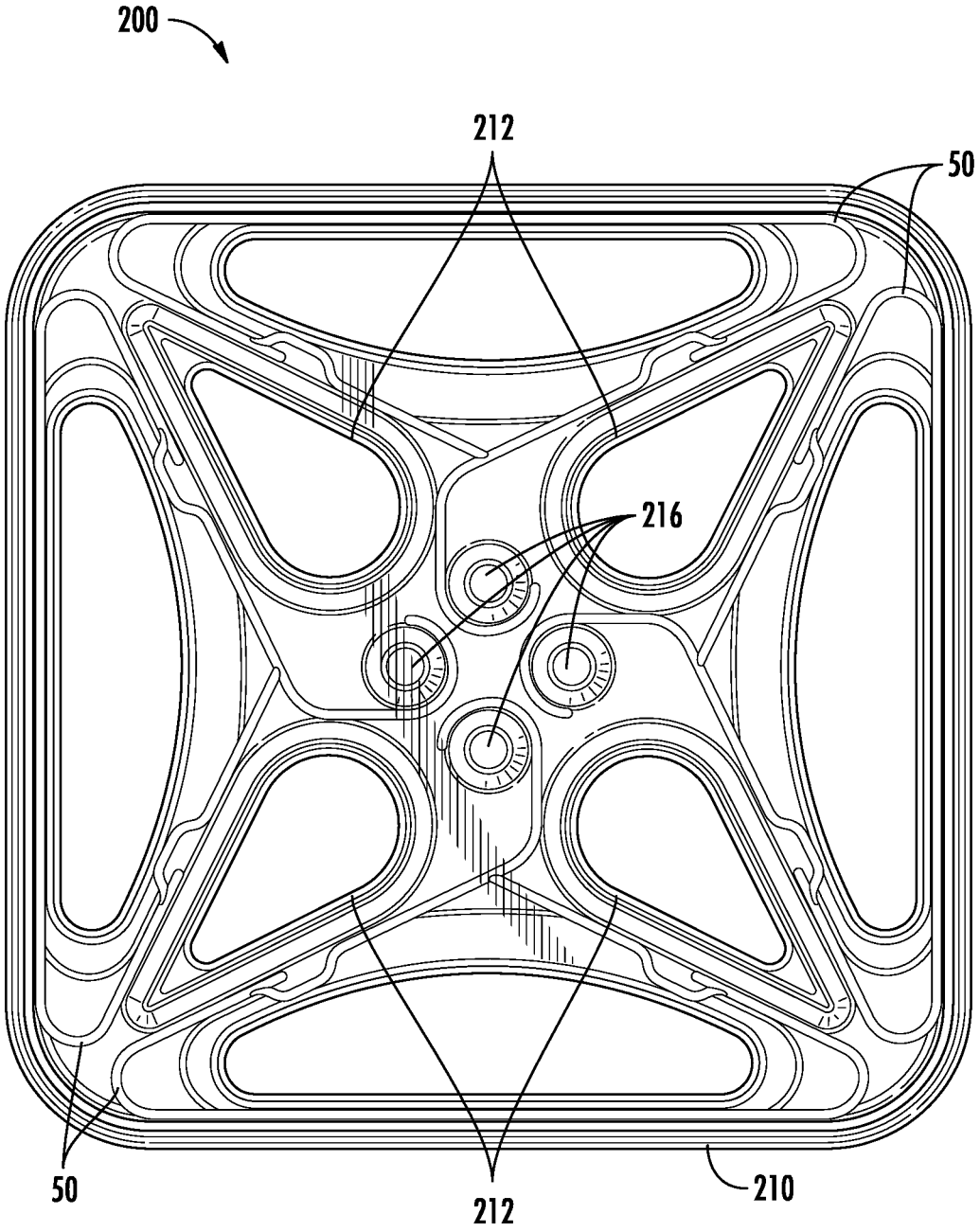
Figure 10:
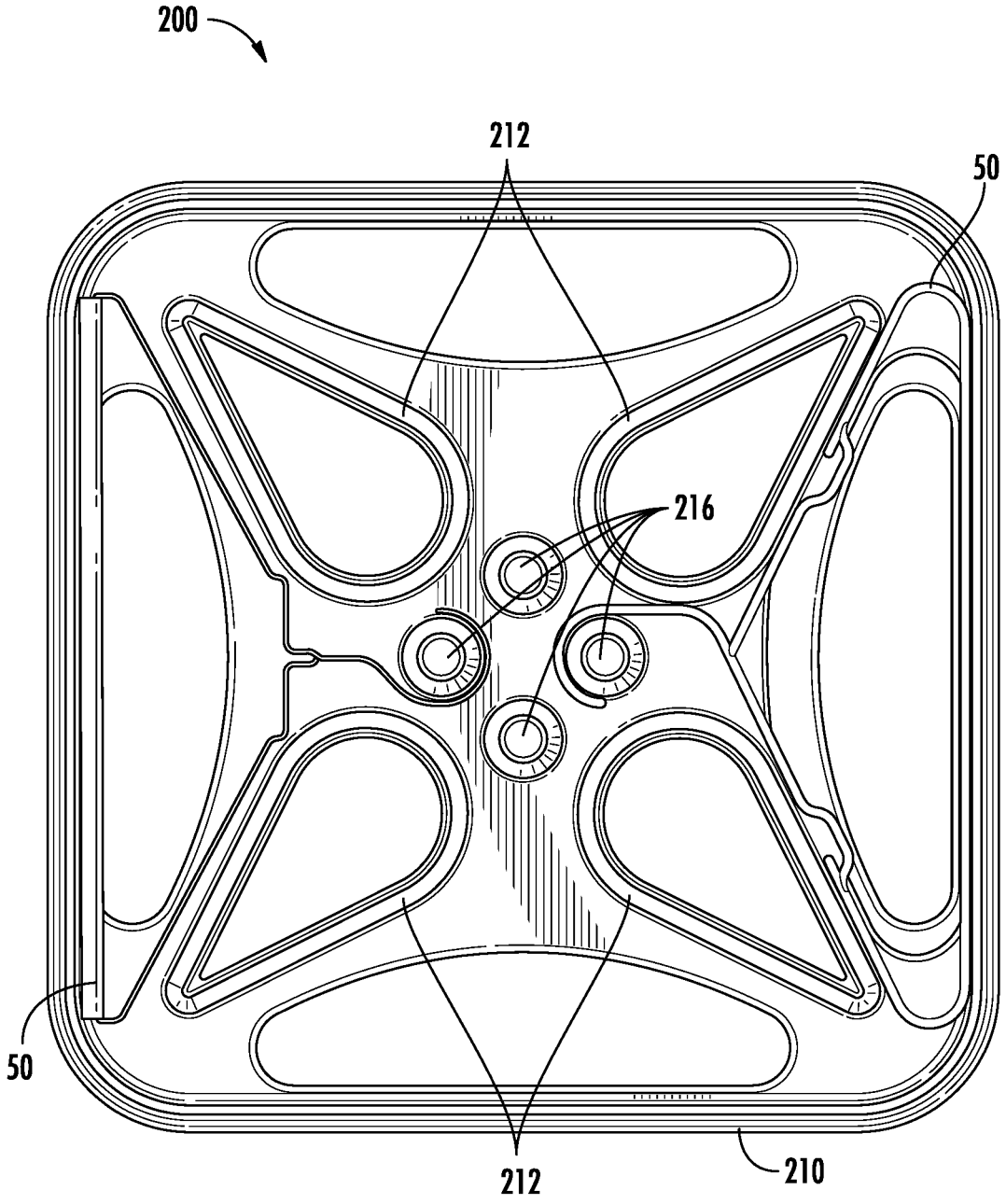
Figure 11:
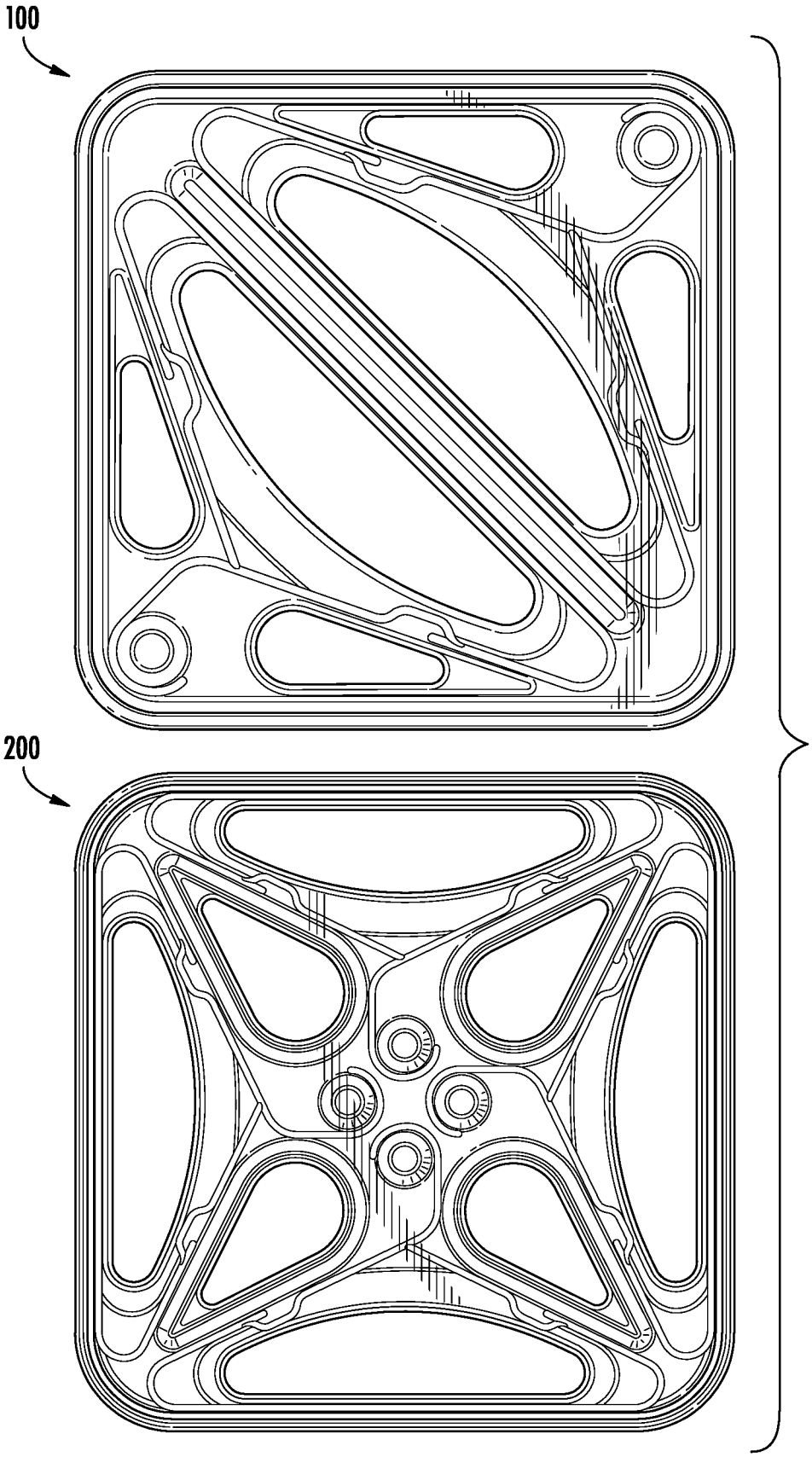
Figure 12:
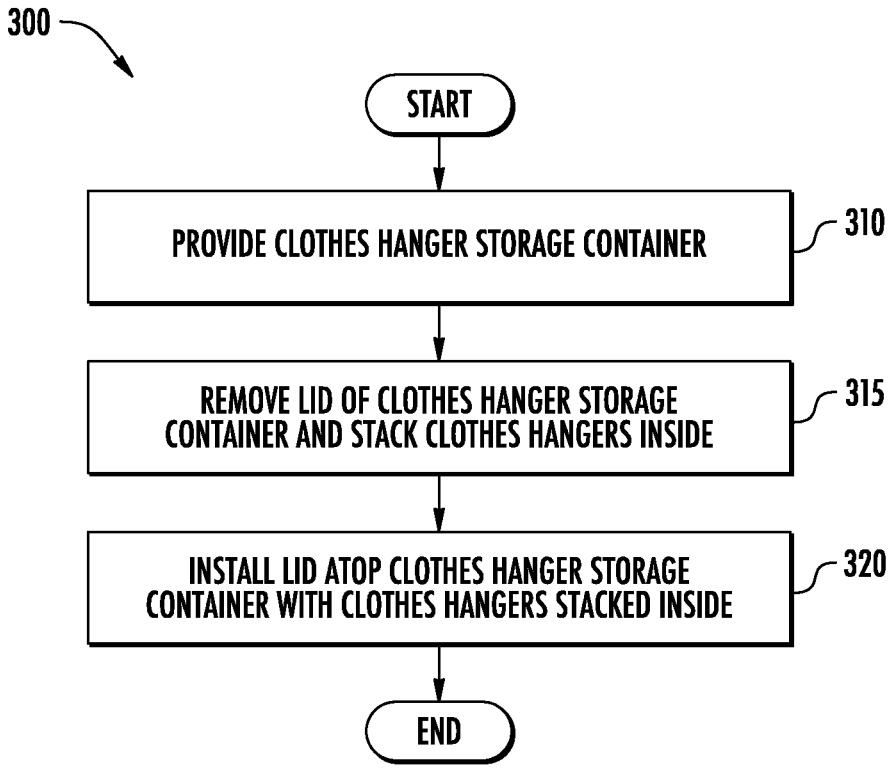

Having thus described the subject matter of the invention in general terms, reference will now be made to the accompanying drawings, which are not necessarily drawn to scale, and wherein:

FIG. 1 illustrates a top view, a side view, an exploded view, and a cross-sectional view of a hanger storage container, in accordance with an embodiment of the invention;

FIG. 2 and FIG. 3 illustrate a top perspective view and a bottom perspective view, respectfully, of the hanger storage container shown in FIG. 1 when empty;

FIG. 4 illustrates a top perspective view of the hanger storage container shown in FIG. 1 when holding hangers;

FIG. 5 and FIG. 6 illustrate top views of the hanger storage container shown in FIG. 1 when holding hangers and absent the container lid;

FIG. 7 illustrates a top view, a side view, an exploded view, and a cross-sectional view of a hanger storage container, in accordance with another example embodiment of the invention;

FIG. 8 illustrates a top perspective view of the hanger storage container shown in FIG. 7 when holding hangers;

FIG. 9 and FIG. 10 illustrate top views of the hanger storage container shown in FIG. 7 when holding hangers and absent the container lid;

FIG. 11 illustrates top views comparing the sizes of the hanger storage container shown in FIG. 1 and the hanger storage container shown in FIG. 7; and FIG. 12 illustrates a flow diagram of an example of a method of using the hanger storage container, in accordance with an embodiment of the invention.

DETAILED DESCRIPTION

The subject matter of the invention now will be described more fully hereinafter with reference to the accompanying drawings, in which some, but not all embodiments of the subject matter of the invention are shown. Like numbers refer to like elements throughout. The subject matter of the invention may be embodied in many different forms and should not be construed as limited to the embodiments set forth herein; rather, these embodiments are provided so that this disclosure will satisfy applicable legal requirements. Indeed, many modifications and other embodiments of the subject matter of the invention set forth herein will come to mind to one skilled in the art to which the subject matter of the invention pertains having the benefit of the teachings presented in the foregoing descriptions and the associated Drawings. Therefore, it is to be understood that the subject matter of the invention is not to be limited to the specific embodiments disclosed and that modifications and other embodiments are intended to be included within the scope of the appended claims.

In some embodiments, the subject matter of the invention provides a hanger storage container (e.g., for clothes hangers) and method of using same.

In some embodiments, the hanger storage container and method may provide a single compartment stackable hanger storage container for holding and storing a plurality of clothes hangers.

In some embodiments, the hanger storage container and method may provide a multi-compartment stackable hanger storage container for holding and storing a plurality of hangers.

In some embodiments, the hanger storage container and method may provide a two-compartment stackable hanger storage container for holding and storing a plurality of hangers.

In some embodiments, the hanger storage container and method may provide a four-compartment stackable hanger storage container for holding and storing a plurality of hangers.

Referring now to FIG. 1 is a top view, a side view, an exploded view, and a cross-sectional view of an example hanger storage container 100, which is one example of the hanger storage container. In one none-limiting example, the hanger storage container is configured for storing clothes hangers. In FIG. 1, the cross-sectional view is taken along line A-A of the top view. Hanger storage container 100 may provide a stackable hanger storage container for holding and storing a plurality of hangers (e.g., clothes hangers).

Hanger storage container 100 may include a container base 110 and a container lid 120 that may be formed, for example, of polypropylene (PP), which is a thermoplastic material. Clothes hanger storage container 100 may be formed of any suitable material.

Container base 110 may be a substantially box-like structure that may include a floor and one or more sidewalls. Container base 110 may include, for example, two compartments 114. Container base 110 may further include, for example, a divider 112 that may span diagonally across container base 110 to form compartments 114. Further, each compartment 114 may include an alignment peg 116 for receiving the hook portion of a clothes hanger (see FIG. 4, FIG. 5, and FIG. 6). Additionally, an arrangement of openings 118 may be provided in the floor of container base 110.

Container lid 120 may be a substantially flat structure, or any other suitable shape. The container lid 120 may include an arrangement of openings 128. In one non-limiting example, the perimeter edge of container lid 120 and the upper edge of container base 110 may be designed to be snap-fitted together. In other embodiments, container lid 120 may attach to container base 110 via any suitable technique or mechanism. Additionally, when container lid 120 is installed on container base 110, the arrangement of openings 118 in container base 110 may substantially align with the arrangement of openings 128 in container lid 120. The number and shape of openings 118 and 128 may vary, and may or may not align with one another. Further, other openings (not shown) may also be provided in one or more sidewalls of hanger storage container 100.

In one non-limiting example, hanger storage container 100 may be in the range of about 15 to about 17 inches wide (e.g., about 16.0 inches wide), in the range of about 15 to about 17 inches long (e.g., about 16.0 inches long), and in the range of about 4 to about 5 inches deep (e.g., about 4.29 inches deep). Further, in one non-limiting example, hanger storage container 100 may hold in the range of about 30 to about 34 standard plastic hangers (e.g., about 32), e.g., a stack of in the range of about 15 to about 17 plastic hangers in each compartment 114 (see FIG. 4). However, hanger storage container 100 is not limited to holding in the range of about 30 to about 34 standard plastic hangers only. For example, hanger storage container 100 may be adjusted to any depth in order to stack any number of hangers (plastic or otherwise). In one non-limiting example, alignment peg 116 may have a height substantially the same as the depth of the hanger storage container 100. Further, in one non-limiting example, divider 112 may have a height substantially the same as the depth of the hanger storage container 100.

Referring now to FIG. 2 and FIG. 3 is a top perspective view and a bottom perspective view, respectfully, of the hanger storage container 100 shown in FIG. 1 when empty. Further, FIG. 4 is a top perspective view of the hanger storage container 100 shown in FIG. 1 when holding hangers.

Hanger storage container 100 is not limited to holding plastic hangers only. Hanger storage container 100 may hold any type of hanger. For example, FIG. 5 shows an example of plastic hangers 50 in each compartment 114. Additionally, FIG. 6 shows an example of a mix of plastic hangers 50 and wire hangers 50 in hanger storage container 100. FIG. 5 and FIG. 6 show the hanger storage container 100 absent container lid 120. Additionally, FIG. 5 and FIG. 6 show the hook portion of each hanger 50 engaged with an alignment peg 116 and with the long portion of each hanger 50 oriented toward divider 112.

Referring now to FIG. 7 is a top view, a side view, an exploded view, and a cross-sectional view of a hanger storage container 200, which is another example of the disclosed hanger storage container. In FIG. 7, the cross-sectional view is taken along line A-A of the top view. Hanger storage container 200 provides a stackable hanger storage container for holding and storing a plurality of hangers (e.g., clothes hangers).

Hanger storage container 200 may include a container base 210 and a container lid 220 that may be formed, for example, of polypropylene (PP), or any other suitable material.

Container base 210 may be a substantially box-like structure that may include a floor and one or more sidewalls. Container base 210 may include, for example, four compartments 214. Container base 210 may further include, for example, dividers 212 that may generally span diagonally inward from each corner of container base 110 to at least partially form/define compartments 214. Further, each compartment 214 may include an alignment peg 216 for receiving the hook portion of a hanger (see FIG. 8, FIG. 9, and FIG. 10). Additionally, an arrangement of openings 218 may be provided in the floor of container base 210.

Container lid 220 may be a substantially flat structure, or any other suitable shape. The container lid 220 may include an arrangement of openings 228. In one non-limiting example, the perimeter edge of container lid 220 and the upper edge of container base 210 may be designed to be snap-fitted together. In other embodiments, container lid 220 may attach to container base 210 via any suitable technique or mechanism. Additionally, when container lid 220 is installed on container base 210, the arrangement of openings 218 in container base 210 preferably substantially aligns with the arrangement of openings 228 in container lid 220. The number and shape of openings 218 and 228 may vary, and may or may not align with one another. Further, other openings (not shown) may also be provided in one or more sidewalls of hanger storage container 200.

In one non-limiting example, hanger storage container 200 may be in the range of about 20 to about 22 inches wide (e.g., about 21.1 inches wide), in the range of about 20 to about 22 inches long (e.g., about 21.1 inches long), and in the range of about 4 to about 5 inches deep (e.g., about 4.29 inches deep). Further, in one non-limiting example, hanger storage container 200 may hold in the range of about 60 to about 68 plastic hangers (e.g., about 64), e.g., a stack of about 15 to about 17 plastic clothes hangers (e.g., about 16) in each compartment 214 (see FIG. 8). However, hanger storage container 200 is not limited to holding in the range of about 60 to about 68 clothes hangers only. For example, hanger storage container 200 may be adjusted to any depth in order to stack any number of hangers (plastic or otherwise). In one non-limiting example, one or more alignment pegs 216 may have a height substantially the same as the depth of the hanger storage container 200. Further, in one non-limiting example, dividers 212 may have a height substantially the same as the depth of the hanger storage container 200.

Referring now to FIG. 8 is a top perspective view of the hanger storage container 200 shown in FIG. 7 when holding hangers.

Hanger storage container 200 is not limited to holding plastic hangers only. Hanger storage container 200 may hold any type of hangers (e.g., clothes or otherwise). For example, FIG. 9 shows an example of plastic hangers 50 in each compartment 214. Additionally, FIG. 10 shows an example of a mix of plastic hangers 50 and wire hangers 50 in hanger storage container 200. FIG. 9 and FIG. 10 show the hanger storage container 200 absent container lid 220. Additionally, FIG. 9 and FIG. 10 show the hook portion of each hanger 50 engaged with an alignment peg 216 near the center portion of container base 210 and with the long portion of each hanger 50 oriented toward the outside perimeter of container base 210.

Referring now to FIG. 11 is top views comparing the sizes of hanger storage container 100 and hanger storage container 200. For example, in one non-limiting example, hanger storage container 100 may be in the range of about 16 inches×about 16 inches, whereas hanger storage container 200 may be in the range of about 21.1 inches×about 21.1 inches.

Referring now to FIG. 12 is a flow diagram of an example of a method 300 of using the disclosed hanger storage containers. Method 300 may include, but it not limited to, the following steps.

At a step 310, the disclosed hanger storage container is provided. In one example, hanger storage container 100 described with reference to FIG. 1 through FIG. 6 is provided. In another example, hanger storage container 200 described with reference to FIG. 7 through FIG. 10 is provided.

At a step 315, the lid of the hanger storage container may be removed and then hangers are stacked inside. In one example, container lid 120 of hanger storage container 100 may be removed and then hangers 50 may be stacked inside, as shown, for example, in FIG. 5. In another example, container lid 220 of hanger storage container 200 may be removed and then hangers 50 may be stacked inside, as shown, for example, in FIG. 9.

At a step 320, the lid may be installed atop the hanger storage container with the hangers stacked inside. In one example, container lid 120 may be installed atop hanger storage container 100 with the hangers 50 stacked inside, as shown, for example, in FIG. 4. In another example, container lid 220 may be installed atop hanger storage container 200 with the hangers 50 stacked inside, as shown, for example, in FIG. 8.

In summary and referring now again to FIG. 1 through FIG. 6 and FIG. 11, the hanger storage container 100 and method 300 provide a multi-compartment (e.g., two-compartment) stackable hanger storage container for holding and storing a plurality of hangers.

In summary and referring now again to FIG. 7 through FIG. 11, the hanger storage container 200 and method 300 provide a multi-compartment (e.g., four-compartment) stackable hanger storage container for holding and storing a plurality of hangers.

The disclosed hanger storage containers are not limited to a two-compartment or four-compartment hanger storage container, but rather may include any number of compartments, including a single compartment.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A hanger storage device, comprising:

a. a container base, the container base comprising a floor and first, second, third, and fourth sidewalls;

b. a divider disposed and extending substantially across the container base from a first corner region formed at the intersection of the first and second sidewalls of the container base to a third corner region formed at the intersection of the third and the fourth sidewalls of the container base, the divider dividing the container base substantially in half diagonally;

c. two compartments defined at least partially by the floor, sidewalls, and divider;

d. two alignment pegs, a first one of the two alignment pegs disposed in a second corner region formed at the intersection of the second and third sidewalls of the container base and a second one of the two alignment pegs disposed in a fourth corner region formed at the intersection of the fourth and first sidewalls of the container base, the two alignment pegs being diagonally opposite one another, and wherein the two alignment pegs are formed in the floor and extend perpendicularly upward therefrom, and wherein the two alignment pegs are configured to receive a hook portion of a hanger; and e. a lid, wherein the lid is configured to secure atop the sidewalls thereby enclosing the two compartments.

2. The hanger storage device of claim 1, wherein the container base comprises a generally box-like structure.

3. The hanger storage device of claim 1, wherein the two compartments are each configured to receive a plurality of hangers in a stacked configuration therein.

4. The hanger storage device of claim 3, wherein the two alignment pegs are configured to be engageable with the hook portion of the plurality of hangers when received in either or both of the two compartments.

5. The hanger storage device of claim 1, further comprising an arrangement of one or more openings in one or both of the container base and lid.

6. The hanger storage device of claim 5, wherein the floor of the container base and the lid each comprise an arrangement of the one or more openings formed therein, and wherein the arrangement of the one or more openings formed in the floor of the container base substantially align with the arrangement of the one or more openings formed in the lid.

7. The hanger storage device of claim 1, wherein a perimeter edge of the lid and an upper edge of the container base sidewalls are configured to snap-fit together.

8. A method of storing a plurality of hangers in a hanger storage device, the method comprising:

a. providing a hanger storage device, comprising:

i. a container base, the container base comprising a floor and first, second, third, and fourth sidewalls;

ii. a divider disposed and extending substantially across the container base from a first corner region formed at the intersection of the first and second sidewalls of the container base to a third corner region formed at the intersection of the third and the fourth sidewalls of the container base, the divider dividing the container base substantially in half diagonally;

iii. two compartments defined at least partially by the floor, sidewalls, and divider;

iv. two alignment pegs, a first one of the two alignment pegs disposed in a second corner region formed at the intersection of the second and third sidewalls of the container base and a second one of the two alignment pegs disposed in a fourth corner region formed at the intersection of the fourth and first sidewalls of the container base, the two alignment pegs being diagonally opposite one another, and wherein the two alignment pegs are formed in the floor and extend perpendicularly upward therefrom, and wherein the two alignment pegs are configured to receive a hook portion of a hanger; and v. a lid, wherein the lid is configured to secure atop the sidewalls thereby enclosing the two compartments;

b. stacking a plurality of hangers in one or more of the two compartments, wherein the hook portion of the plurality of hangers engage with a corresponding one of the two alignment pegs; and c. securing the lid atop the one or more sidewalls.

* * * * *